United States Patent [19]

Fulton

[11] 4,383,149

[45] May 10, 1983

[54] PUSH-BUTTON SWITCH WITH IMPROVED ROCKING CONTACTOR SWITCH MECHANISM

[75] Inventor: Edward Fulton, Costa Mesa, Calif.

[73] Assignee: Eaton Corporation, Cleveland, Ohio

[21] Appl. No.: 386,160

[22] Filed: Jun. 7, 1982

[51] Int. Cl.[3] ..... H01H 21/40; H01H 19/00

[52] U.S. Cl. ..... 200/68; 200/159 R; 200/244; 200/6 R; 200/267

[58] Field of Search ..... 206/67 R, 67 A, 67 G, 206/153 W, 244, 267, 268, 271, 272, 315, 339; 200/6 R, 159 R, 237, 238, 239, 68, 275, 278, 282

[56] References Cited

U.S. PATENT DOCUMENTS

| | | | |
|---|---|---|---|
| 1,883,126 | 10/1932 | Tregoning | 200/271 X |
| 2,248,361 | 7/1941 | Krieger | 200/68 |
| 2,856,492 | 10/1958 | Heyhal | 200/284 |
| 3,639,714 | 2/1972 | Fujimoto et al. | 200/67 G X |
| 3,646,291 | 2/1972 | Bienwald et al. | 200/67 G X |
| 3,694,598 | 9/1972 | Nishikawa et al. | 200/67 G |
| 3,735,079 | 5/1973 | Dieterich | 200/267 X |
| 3,780,247 | 12/1973 | Healy et al. | 200/267 |
| 3,999,024 | 12/1976 | Marquardt | 200/67 G X |
| 4,053,726 | 10/1977 | Schaad | 200/159 R |
| 4,121,071 | 10/1978 | Campbell et al. | 200/67 G |
| 4,291,207 | 9/1981 | Reinke et al. | 200/42 R |

FOREIGN PATENT DOCUMENTS

| | | | |
|---|---|---|---|
| 2224749 | 11/1978 | Fed. Rep. of Germany | 200/68 |
| 1157373 | 5/1958 | France | 200/67 G |
| 593175 | 5/1959 | Italy | 200/67 G |
| 499599 | 1/1974 | U.S.S.R. | 200/268 |

*Primary Examiner*—John W. Shepperd
*Assistant Examiner*—Ernest Cusick
*Attorney, Agent, or Firm*—C. H. Grace; L. G. Vande Zande

[57] ABSTRACT

A push-button switch wherein a spring loaded plunger (22) is carried by a push-button operator (4) along a surface of a rocking contactor (20) across the plane of the support contact (16) for the contactor (20) to rock that contactor into and out of engagement with stationary contacts (12, 14). A U-shaped conductive bearing (18) is mounted over the end of the support contact (16) to provide a uniformly smooth pivot and current transfer surface for the contactor (20). The plunger (22) and spring (24) are loaded in a through-hole (4f) in the operator (4) wherein the spring (24) may be compressed just prior to final assembly into a switch housing (2), facilitating assembly operations for the switch.

13 Claims, 4 Drawing Figures

14
14a
20b
16a
16b
18
16b
16
20a
20a
20
12a
20b
12

PUSH-BUTTON SWITCH WITH IMPROVED ROCKING CONTACTOR SWITCH MECHANISM

BACKGROUND OF THE INVENTION

A rocking contactor switch mechanism comprises a contactor pivotally supported at the end of a stationary contact blade to rock or teeter into and out of engagement with stationary contacts mounted on either side of the supporting contact. A spring biased plunger is driven linearly along the surface of the contactor to actuate it from one position to the other as the plunger moves across the pivot point which is the perpendicular plane of the supporting contact blade. The pivot point for the contactor is also the current carrying connection between the contactor and blade contact whereby the contactor electrically bridges an outer stationary contact with the supporting blade contact. For smooth operation and good current transfer between the contactor and the supporting blade contact, it is important that the pivot edge of the blade contact be smooth along its length for uniform engagement with the contactor. To further enhance current transfer between these members it is customary to plate one or both members with a superior current conducting metal such as the precious metals gold or silver.

An economically preferred method of manufacturing contact terminals for use in switches of this type is to blank the members from a metal sheet. This process creates a clean cut approximately halfway through the metal and then shears or tears the material through the balance of the thickness. The resulting edge is smooth only for a portion and has a relatively rough surface on the other portion and is therefore undesirable as a pivot edge for a contactor. Another problem exists with respect to plating the supporting blade contact terminal. The member can most readily be bulk plated, although in such process the entire piece contains plating of silver or gold, which is economically undesirable. An alternative method is to plate a selective area of the stationary contact blade, but this is a more complicated process.

Another problem associated with contact mechanisms of this type is the assembly of the spring biased plunger to the switch operator. In most designs a blind hole is provided in a linearly moveable operator and a hollow plunger element with a spherical end is provided in the open end of this hole. A helical compression spring is disposed within the holes of the plunger and the operator to bias the plunger outwardly against the contactor surface. It is necessary to subassemble the switching mechanism and the operator before positioning the parts within a housing, and in the aforementioned devices the spring loaded plunger provides an unstable condition for the subassembly prior to final assembly.

SUMMARY OF THE INVENTION

This invention provides an improved pivot and current transfer surface for the supporting blade contact of a rocking contactor switch mechanism. A U-shaped bearing clip, which may conveniently be bulk plated with a precious metal, is disposed over the end of the supporting blade contact to provide a uniformly smooth, round and resilient plated pivot surface for the contactor. A spring biased actuating plunger for the rocking contactor is contained in a through-hole provided in a switch operator member. The plunger has a rearwardly projecting, reduced diameter pin to fit within the inner diameter of the spring to thereby hold the plunger to the spring. The plunger and spring may be assembled to the operator as the operator and switching components are inserted into a housing for the switch and the spring compressed to be received within the interior of the switch housing upon assembly. Accordingly the spring bears between an interior housing wall and the end of the plunger to bias the plunger against the surface of the rocking contactor.

DESCRIPTION OF THE PREFERRED EMBODIMENT

Figure 2:
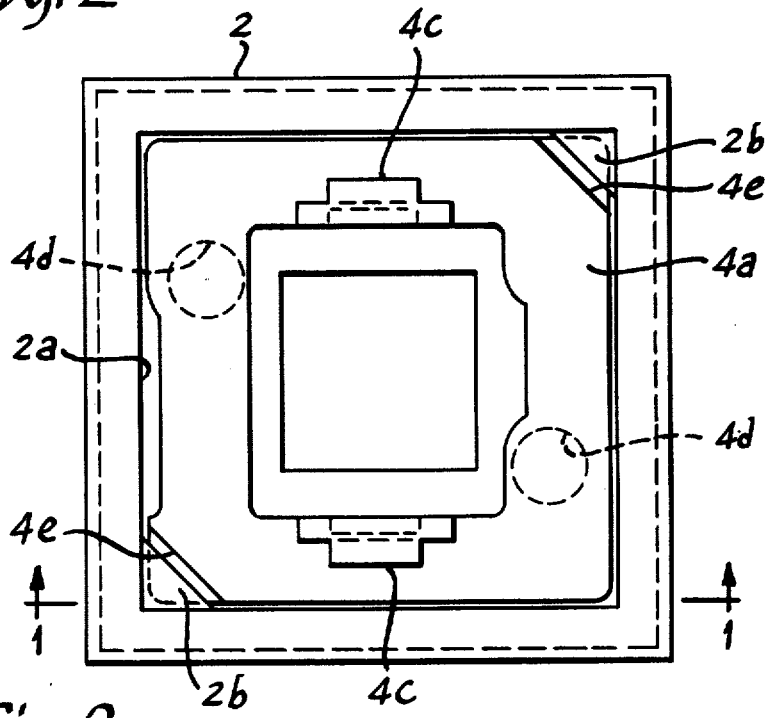
FIG. 2 is a top or front view of the switch of FIG. 1 with the button cap removed.
Figure 3:
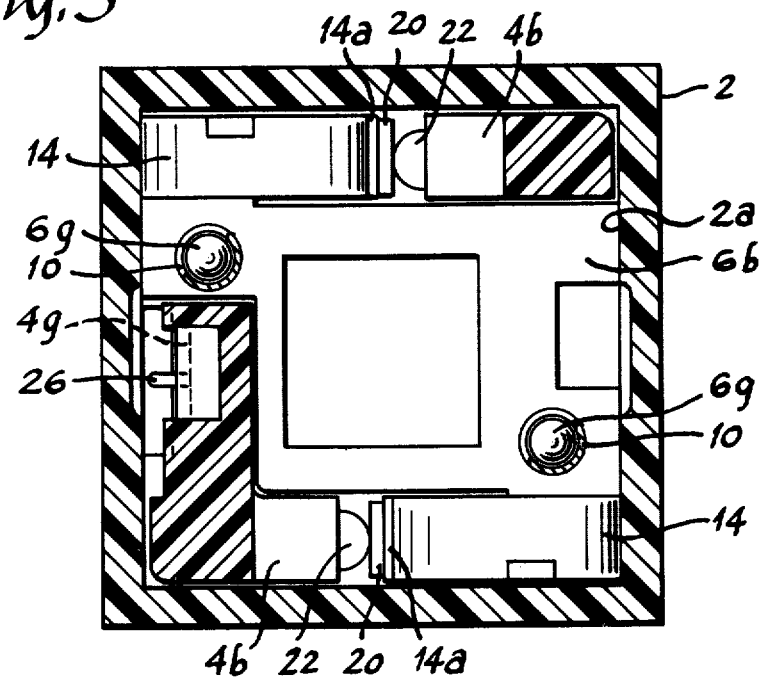
FIG. 3 is a transverse sectional view taken along the line 3—3 of FIG. 1.

The switch embodying the improved contact mechanism of this invention is a push-button switch which has a hollow rectangular housing 2 for receiving a molded operator 4 and a molded switch base 6 therein. The transverse configuration of the switch is essentially square as seen in FIGS. 2 and 3. The switch is a double pole device having contact switching mechanisms located along forward and rear walls as it is oriented in the drawings. The center portion of the switch is essentially open and may contain a lamp structure if desired.

Figure 1:
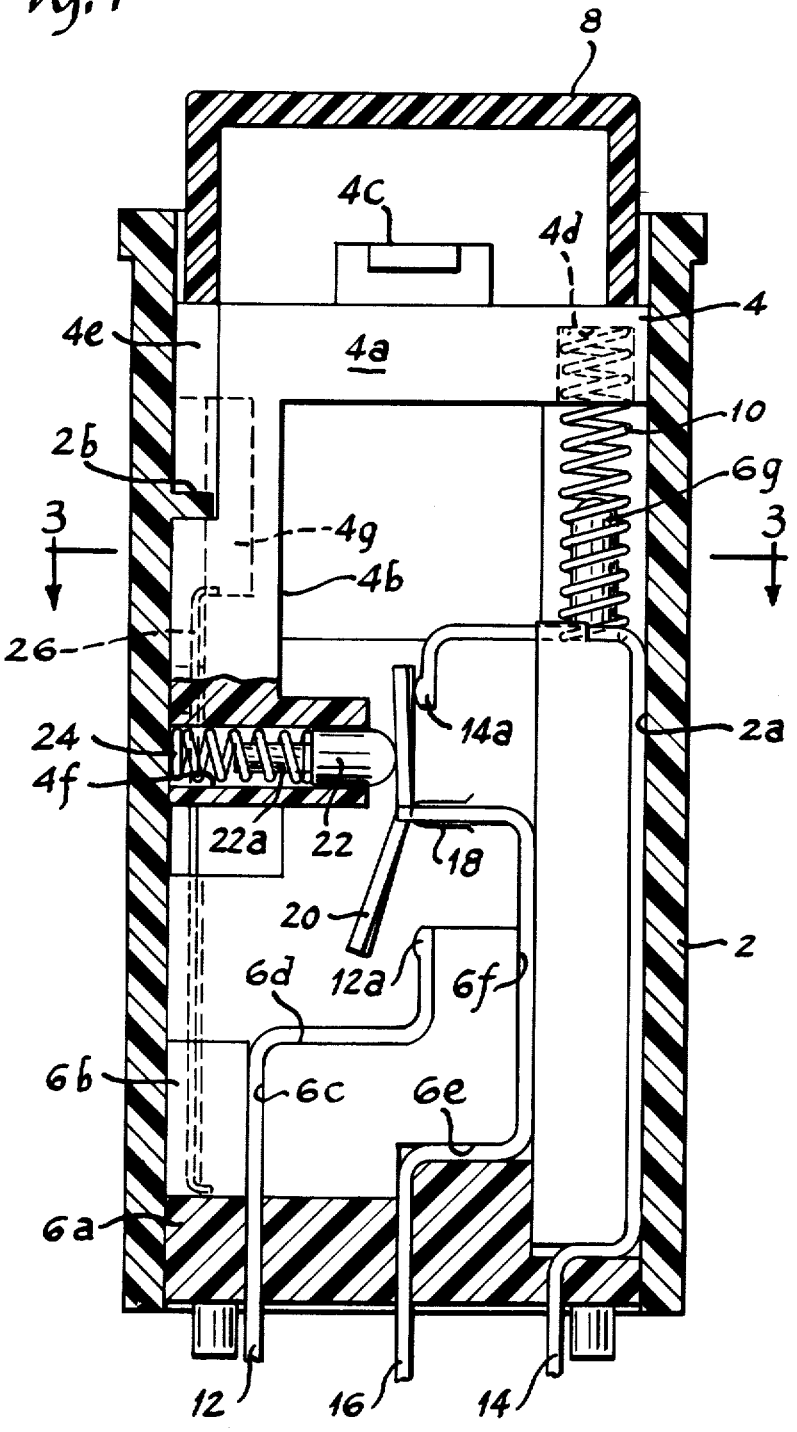
FIG. 1 is a longitudinal sectional view taken along the line 1—1 of FIG. 2 of a push-button switch having a rocking contactor mechanism according to this invention.

Operator 4 comprises a molded platform **4*a* which is essentially square in plan view (FIG. 2) and has a pair of contact actuator legs 4*b* projecting downwardly at diagonally opposite corners thereof (FIGS. 1 and 3). At the top surface, platform 4*a* has a pair of upstanding hooks 4*c* molded integrally with the platform to receive a molded button cap 8 by means of a snap fit with corresponding depressions (not shown) in the cap. The underside of platform 4*a* has a pair of diagonally located cylindrical recesses or blind holes 4*d* which are open to the underside of platform 4*a* for receiving helical springs 10 therein. As seen in FIGS. 1 and 2, a pair of diagonally opposite corners of platform 4*a* have a chamfered groove 4*e* which cooperate with fillets 2*b* in the housing 2 for orientation of the platform with respect to the housing and to provide a stop for the outward travel of operator 4 and cap 8**.

Figure 4:
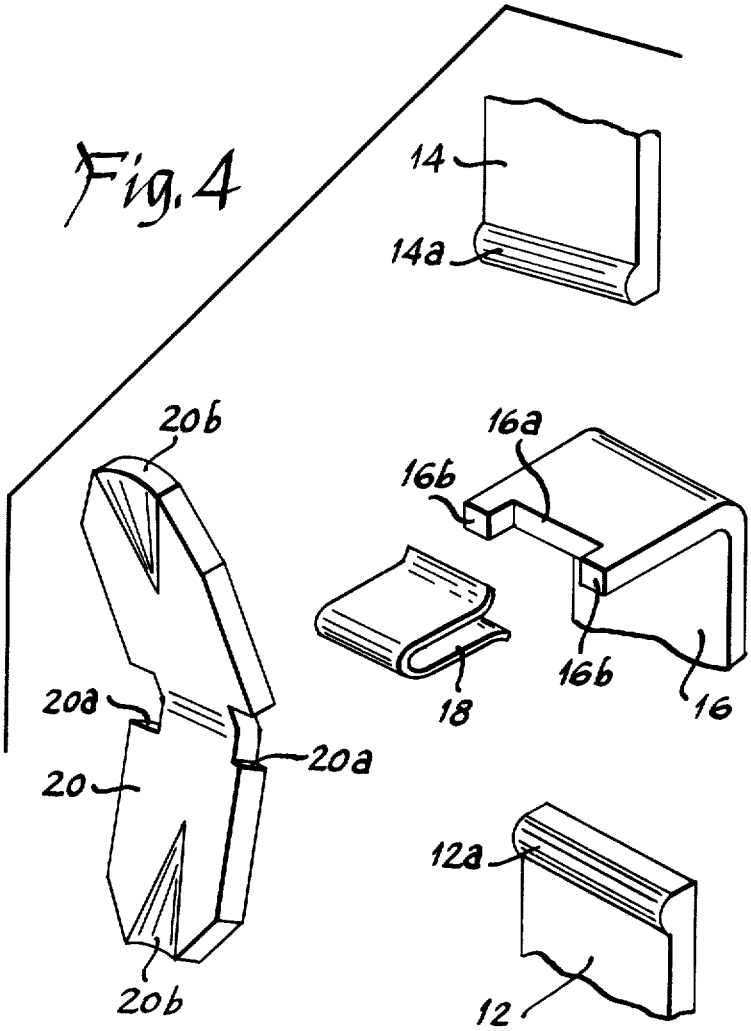
FIG. 4 is an exploded isometric view of the contact assembly of this invention.

The base 6 is a two part assembly having a molded header **6*a* and a molded terminal support block 6*b* which may be snap-fit together or be secured together by an adhesive or the like. The forward and rear surfaces of the terminal support block 6*b* are configured to receive and mount the stationary contact terminal members of each pole of the switch. Only the forward surface of terminal support block 6*b* is shown in detail in this regard, the rear surface being reversely oriented but otherwise identical therewith. A first stationary contact terminal member 12 projects through an opening in header 6*a* and extends vertically into the switch within a groove 6*c* in the terminal support block 6*b*. The inner portion of terminal 12 is formed over at a first right angle to extend along a horizontal shelf 6*d* in terminal support block 6*b* and is subsequently reversely formed over at a second right angle to project further inwardly of the switch along a vertical extension of the shelf 6d. The innermost end of contact terminal 12 has a hump portion 12a which serves as one stationary contact of the switch. A second stationary contact terminal 14 projects through an opening in header 6a, is offset to the right by virtue of a pair of successive, reverse right angles, and extends upwardly into the switch along the right hand edge of terminal support block 6b and is entrapped between the support block 6b and the interior 2a of switching housing 2. At its innermost end contact terminal 14 is formed over at successive right angles and its terminating end formed with a hump 14a to provide the second stationary contact for the switch. It may be noted in FIG. 1 that the contact terminals 12 and 14 are formed such that the stationary contact portions 12a and 14a are aligned in a common vertical plane. A third stationary contact terminal 16 projects through an opening in header 6a, is offset to the right by successive, reverse right angles, and extends horizontally along an interior surface of header 6a in a groove formed by that surface of the header and a horizontal overhanging wall 6e of terminal support block 6b. A vertical groove 6f, continuous with the wall 6e, supports the terminal 16 as it extends upwardly into the switch. The innermost end of terminal 16 is formed over at a right angle to extend horizontally between the contacts 12a and 14a. The innermost end of contact terminal 16 is best seen in FIG. 4 wherein it may be seen to contain a central slot 16a leaving outwardly projecting ears 16b** along the opposite edges of the contact terminal.

A bearing clip 18 which is formed in a U-shape and having outwardly flared ends is positioned over the end of contact terminal 16 within the slot 16a. The clip 18 is made of a good electrically conductive spring material such as beryllium copper or the like and is bulk plated with gold or silver for enhanced current conduction. The bight of the U-shaped clip is formed by a continuous radius to provide a smooth, rounded surface within the groove 16a. A shallow V-shaped contactor 20 is provided at its center with lateral notches 20a. The outer ends of contactor 20 are deformed to provide contact surfaces 20b thereon. Contactor 20 is pivotally supported upon the stationary contact terminal 16 within the groove 16a by engagement of the ears 16b with notches 20a in the contactor and rests upon the rounded bight portion of bearing clip 18.

Actuator legs 4b of operator 4 contain cylindrical holes 4f formed in the transverse plane of the switch to receive an actuator plunger 22 therein. The plunger 22 is substantially cylindrical and is guided for axial movement within the hole 4f. The projecting end of plunger 22 is semi-spherical and bears upon the surface of contactor 20. The opposite end of plunger 22 has a reduced diameter pin 22a projecting therefrom. A helical compression spring 24 is snuggly received on pin 22a at one end and bears against the interior surface of opening 2a of housing 2 at the other end to bias the plunger 22 into engagement with the surface of contactor 20.

The innermost or upper surface of terminal support block 6b is provided with pins 6g which are cooperatively aligned with the blind holes 4d of platform 4a to position the lower end of springs 10. Springs 10 bias the operator member 4 to its outermost position wherein the bottom of grooves 4e engage fillets 2b of the housing.

The switch contacts may be operated from the position shown in FIG. 1 wherein contacts 14 and 16 are electrically bridged by depressing the button cap 8 and therefore operator 4 to cause plunger 22 to linearly traverse the V-shaped surface of contactor 20. As the plunger moves across the plane of stationary contact 16, the contactor will rock counterclockwise to be in engagement with stationary contact 12a and center contact 16, thereby rocking the opposite end thereof out of engagement with stationary contact 14a. Springs 10 return the operator member 4 to its extended position upon the release of button cap 8, thereby carrying the plunger 22 back across the plane of center contact 16 to reverse the actuation of the contactor 20. As thus described, the switch is a momentary switch, returning to its original position upon release of an operating force.

A "latched-on" wire 26 may be provided as shown along the left-hand surface of the terminal block 6b to provide a sequential push-push operation for the switch, thereby latching the switch operator 4 in the depressed position upon an initial depression and releasing the operator upon a subsequent depression. The upper end of wire 26 is formed over to engage a cam groove 4g provided in the operator 4 for such purpose. The details of the cam surfaces for this purpose are well known in the switch art and have not been specifically illustrated herein. It should further be recognized that the switch may also be a single-throw switch by eliminating one of the stationary contacts and substituting therefore a stop member in a manner also well known in the switch art.

The assembly procedure for the switch will next be described. The stationary contact terminals 12, and 14 and blade contact 16 with clip 18 mounted thereon are mounted to the terminal support block 6b and the header 6a is subsequently positioned over the outer ends of the contact terminals and secured to the terminal support block 6b by a suitable adhesive or the like. Contactors 20 are positioned on the blade contacts 16. The "latch-on" wire 26 is positioned in a suitable recess in the support block 6b to extend upwardly along a side of that block. Springs 10 are positioned over the upstanding pins 6g and the operator 4 is assembled over the springs such that the upper ends of springs 10 are received within the holes 4d and the upper end of the "latch-on" wire is positioned in the cam groove 4g. This subassembly is then inserted into the housing 2 from the lower end thereof until the holes 4f in operator 4 approach the lower edge of the housing 2. At that time, the plungers 22 and springs 24 are assembled and inserted into openings 4f from the outer edge of operator 4. The ends of springs 24 are held flush with the outer surface of operator 4 while the subassembly is then pushed further into the housing 2 such that the ends of springs 24 engage with the inner surface 2a of the housing. The entire assembly may then be inserted fully within the housing to a point where the header 6a may preferrably snap-fittingly engage the housing by suitable formations (not shown). The cap 8 may be snapped onto the hooks 4c of operator 4 from the upper or forward end of the switch.

The provision of spring clip 18 reduces the amount of precious metals such as silver or gold required and yet permits more convenient bulk plating of a much smaller part instead of the significantly larger blade contact terminal 16. Bulk plating is preferable to selective area plating of only the innermost end of stationary contact terminal 16 because it is a simpler and less expensive process. The round bight portion of bearing clip 18 provides a uniformly smooth and rounded pivot and current transfer surface for the contactor 20, enabling the blade contact 16 to be formed by the economical blanking process. The provision of through-holes 4f for actuator plungers 22 and springs 24 simplifies the assembly procedure of the switch and renders the switch capable of automated assembly.

While the improved rocking contactor switch mechanism shown herein has been described in connection with a particular push-button switch, it should be readily apparent that it may be incorporated in other types of switches such as toggle and rocker operated switches. It is to be understood that the invention as described herein is susceptible to various modifications without departing from the scope of the appended claims.

I claim:

1. A rocking contactor electric switching structure comprising, in combination:

a blade contact;

a rocking contactor pivotally mounted on an end of said blade contact terminal;

stationary contact means;

actuator means engaging a surface of said rocking contactor, said actuator means including spring means biasing said actuator and said contactor toward said end of said blade contact;

operator means for moving said actuator means along said contactor surface across the plane of said blade contact for rocking said contactor into engagement with said stationary contact means to electrically bridge said blade contact and said stationary contact means; and an electrically conductive U-shaped bearing clip interposed said contactor and said blade contact, said clip being disposed over said end of said blade contact with the bight portion of said clip toward said contactor for providing a uniformly smooth pivot surface for said contactor.

2. The electrical switching structure of claim 1 wherein said bight portion of said clip comprises a continuous radius to thereby present a semi-cylindrical surface upon which said contactor pivots.

3. The electrical switching structure of claim 2 wherein said clip is formed of a spring material whereby leg portions extending from said bight portion are biased toward each other to resiliently grip opposite surfaces of said blade contact.

4. The electrical switching structure of claim 3 wherein said clip is plated with a material having good electrical conductivity properties.

5. The electrical switching structure of claim 3 wherein said clip is plated with gold.

6. The electrical switching structure of claim 3 wherein said clip is plated with silver.

7. The electrical switching structure of claim 3 wherein said blade contact has a pair of projections extending from the end thereof, said contactor has a pair of notches receiving said projections for positioning said contactor on said blade contact, and said clip is disposed between said projections.

8. An electric switch comprising, in combination:

an insulating switch base;

a blade contact terminal mounted on said switch base;

stationary contact terminal means mounted on said switch base;

a rocking contactor pivotally supported on an end of said blade contact terminal;

a hollow enclosure for receiving said switch base wherein terminal portions of said contact terminals extend exteriorly of said enclosure;

an operator mounted for reciprocal movement in said enclosure, said operator having an opening in juxtaposition to said contactor;

an actuator plunger guided for reciprocal movement within said opening;

spring means biasing said actuator plunger into engagement with a surface of said rocking contactor for biasing said rocking contactor toward said end of said blade contact terminal;

said operator being movable to carry said actuator plunger along said surface of said contactor across the plane of said blade contact terminal for rocking said contactor into engagement with said stationary contact terminal means to electrically bridge said blade contact terminal and said stationary contact terminal means; and an electrically conductive U-shaped bearing clip interposed said contactor and said blade contact terminal, said clip being disposed over said end of said blade contact terminal with the bight portion of said clip toward said contactor for providing a uniformly smooth pivot surface for said contactor.

9. The electric switch of claim 8 wherein said opening in said operator extends through said operator to communicate with an interior surface of said enclosure and said spring means comprises a helically wound spring compressed between said actuator plunger and said interior surface of said enclosure.

10. The electric switch of claim 9 wherein:

said enclosure is open at one end thereof;

said operator and said base are partially inserted into said enclosure as a subassembly through said open end to a first depth whereby said opening in said operator is uncovered by said enclosure;

said actuator plunger and said spring are inserted into said opening toward said contactor; and said spring is compressed within said opening and said operator and base subassembly is further inserted into said enclosure to a fully assembled position.

11. The electric switch of claim 10 wherein said actuator comprises a cylindrical plunger having a semi-spherical end engaging said contactor surface and a reduced diameter pin extending from the opposite end thereof and said spring is disposed over said reduced diameter pin.

12. The electric switch of claim 11 wherein said enclosure is made from electrical insulating material.

13. The electric switch of claim 11 wherein said actuator plunger is made of electrical insulating material.

* * * * *